US006568506B1

(12) United States Patent
Donnalley

(10) Patent No.: US 6,568,506 B1
(45) Date of Patent: May 27, 2003

(54) PORTABLE CHILD'S STOOL WITH STORAGE COMPARTMENT

(76) Inventor: Pamela Barker Donnalley, 219 Bedrock Ct., Wilmington, NC (US) 28411

( * ) Notice: Subject to any disclaimer, the term of this patent is extended or adjusted under 35 U.S.C. 154(b) by 0 days.

(21) Appl. No.: 10/079,628

(22) Filed: Feb. 19, 2002

Related U.S. Application Data

(63) Continuation-in-part of application No. 09/933,437, filed on Aug. 20, 2001, now abandoned.

(51) Int. Cl.[7] ..... A47B 3/00
(52) U.S. Cl. ..... 182/223; 182/33; 108/129
(58) Field of Search ..... 182/222, 223, 182/33; D6/32, 349; 108/129; 297/423.41

(56) References Cited

U.S. PATENT DOCUMENTS 3,271,075 A 9/1966 Good
4,383,488 A 5/1983 Macho et al.
4,462,636 A 7/1984 Markson
4,872,410 A * 10/1989 Lilly ..... 108/13
5,218,912 A * 6/1993 Buske ..... 108/26
5,383,411 A * 1/1995 Tomaka et al. ..... 108/129
5,505,142 A * 4/1996 Fink ..... 108/129
5,727,476 A 3/1998 Priore, Sr.
5,855,536 A * 1/1999 Wilkinson ..... 297/423.41

* cited by examiner

*Primary Examiner*—Alvin Chin-Shue
(74) *Attorney, Agent, or Firm*—MacCord Mason PLLC

(57) ABSTRACT

A collapsible step stool with a storage cavity for storing a wipes container is described that includes a platform having upper, side and end walls that together form a storage cavity beneath the upper wall; a removable support shelf with a first access opening positionable beneath the storage cavity; and legs pivotally attached to the platform, the legs being moveable between a closed position beneath the platform and an opened position, the legs having cut-out sections forming a second access opening aligned with the first access opening when the legs are in the closed position to provide access into the storage cavity.

9 Claims, 3 Drawing Sheets

PORTABLE CHILD'S STOOL WITH STORAGE COMPARTMENT

This application is a continuation-in-part of U.S. patent application Ser. No. 09/933,437, filed Aug. 20, 2001 abandon.

BACKGROUND OF THE INVENTION (1) Field of the Invention

The present invention relates to a collapsible, portable step stool, and in particular to a step stool that includes a storage compartment useful for storage of a wipes container.

(2) Description of the Prior Art

Folding or collapsible step stools are manufactured in various configurations, depending upon their end use, the height of the stool, etc. One form of step stool used to increase the user's height by about a foot or so is comprised of a platform upon which the user stands and folding legs having inner ends connected to the ends of the platform. Each leg has a folded position beneath the platform and an extended position in which the leg projects downward and often slightly outward. In the extended position, the distal ends of the legs rest against the floor or other support surface. Normally, a stop prevents the leg from moving outward beyond the desired extended position. For instance, a part of the platform may engage a part of the leg to prevent further outward movement.

Step stools are often used by toddlers and small children to reach the height needed for use of countertops, shelves, lavatories, and the like without the assistance of a parent or other adult. While the stools are used in the home, they also have application when traveling and away from the home. For example, small children often need to use public restrooms, which are designed for adults. Without a stool, the child requires the assistance of an adult to "boost" them to the necessary height for use of the lavatory or other facility.

When using a public restroom, it is also desirable to provide disposable cleaning wipes for use by the child. As used herein, the term "wipes" is intended to mean a disposable cloth, e.g. a synthetic, nonwoven cloth, that may or may not be impregnated with alcohol, soap or other cleanser. Normally, these wipes are sold in dispenser boxes or containers. Carrying of both a step stool and a wipes container, e.g., in a diaper bag, can be cumbersome, especially with all of the other materials that the parent must carry when traveling with a toddler or small child.

Thus, there is a need for a compact step stool that can be easily carried, with the step stool also providing storage for a wipes container.

SUMMARY OF THE INVENTION

Generally, the present invention addresses this need by providing a collapsible step stool having a wipes storage compartment. The present step stool is comprised of a platform and a pair of pivotal legs that are movable between a folded position beneath the platform for transportation and storage of the stool, and an extended position to support the platform above the floor or other surface.

More specifically, the step stool platform is comprised of a generally rectangular upper wall having an upper surface upon which the user stands, and side and end walls, collective referred to as peripheral walls, extending downward from the side and end edges of the upper wall, forming an open bottom container storage cavity beneath the upper wall. At least one end wall, and preferably each end wall, includes an access opening through which a wipes container can be inserted into and removed from the platform cavity. The access opening has width and height dimensions generally corresponding to the width and height dimensions of a wipes container to be stored in the platform cavity.

In order to facilitate insertion and removal of wipes containers into and from the cavity, and to support the container within the cavity, the stool also includes a removable shelf that is slidable through the opening in an end wall. Bottom wall sections extend inwardly from the lower edges of the end walls to provide support for the shelf. The shelf preferably includes at least one port or opening through which wipes can be removed from the container without removing the container from the platform cavity.

Each of the stool legs is comprised of a center section extending substantially the width of the platform, and side sections that extend inwardly from the side edges of the center section. The upper ends of the side sections extend upwardly beyond the center section and are pivotally joined to the outer ends of the platform side walls. The length of each side wall is approximately one-half the length of the platform. As a result, when the legs are in their closed position, the legs are folded flat against the bottom of the platform. In the closed position, the leg center sections are parallel to the platform upper wall, and the leg side sections are positioned along the outer surfaces of the platform side walls.

When in the open, extended position, each leg extends downward and slightly outward from the platform so that downward pressure on the platform urges the legs outward. Stops on the platform formed by the lower surfaces of the bottom wall segments engage the upper edges of the leg center sections, preventing movement of the legs beyond a predetermined position. The lower edge of each leg center section includes a cut-out. When the legs are in the closed position, the cut-out sections of the two legs join to form an access opening aligned with a port in the shelf, and thus providing access into the wipe container for removal of wipes, even when the stool is closed for storage and transportation. If desired, an identification label can be attached to the exterior surface of one of the side walls.

DETAILED DESCRIPTION OF THE INVENTION

Figure 1:
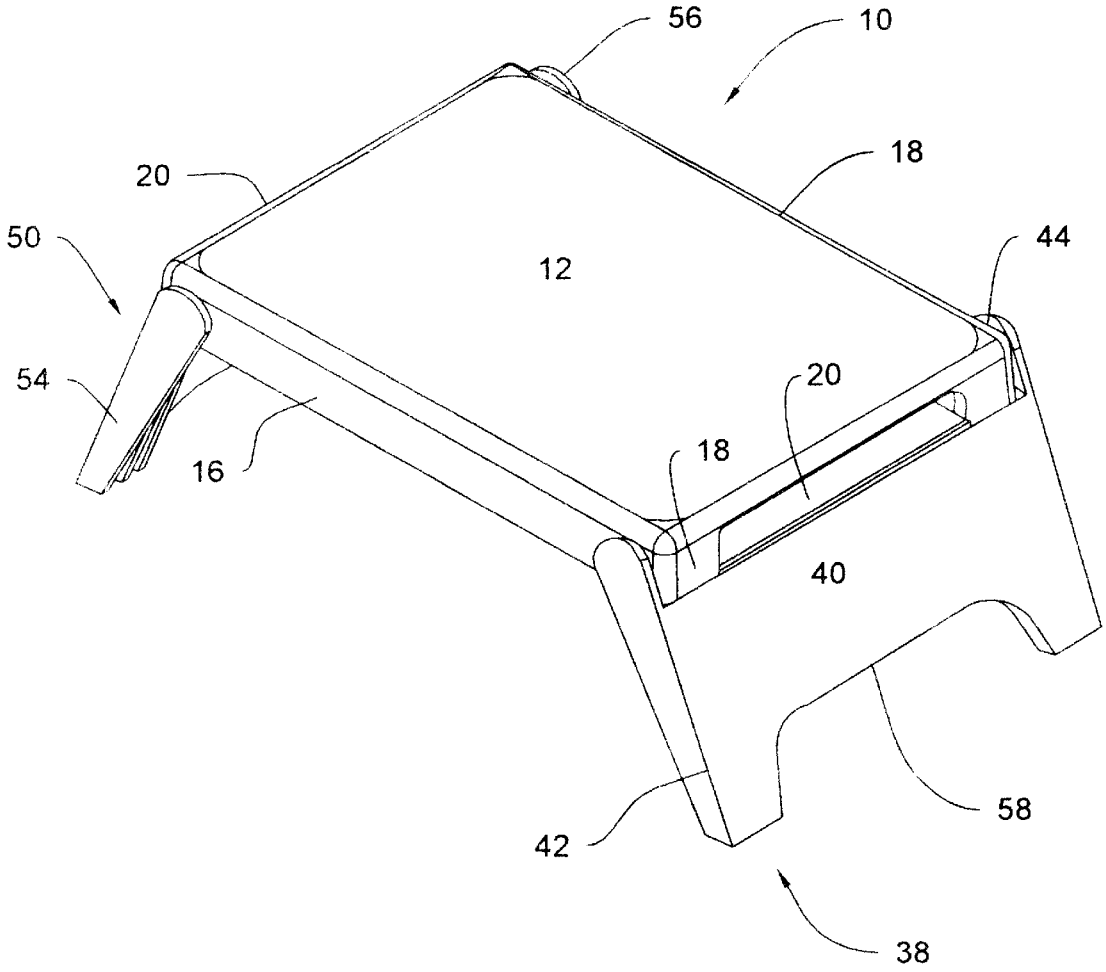
FIG. 1 is a perspective view of the step stool with the legs in the extended position.
Figure 2:
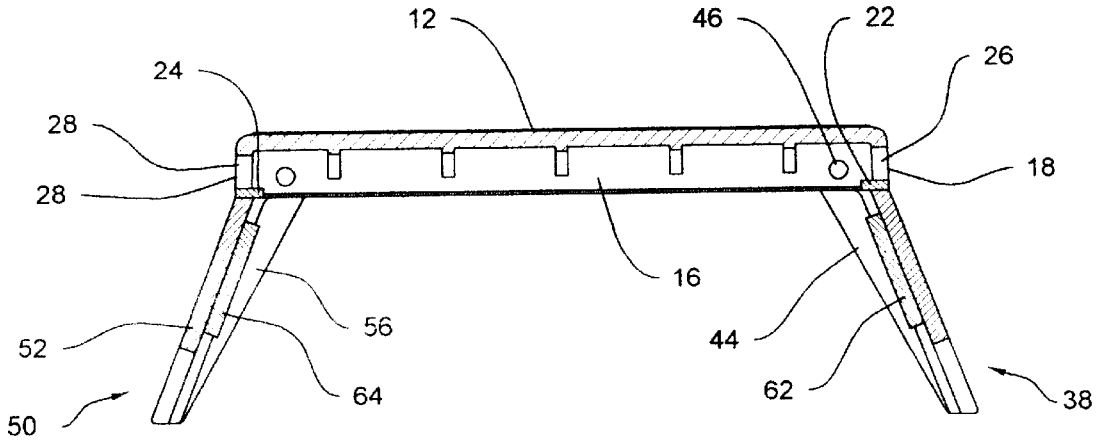
FIG. 2 is sectional side view of the stool with the legs in the extended position.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Step stool, generally 10, is comprised of a platform section having a generally rectangular upper wall 12 with parallel side edges and parallel end edges, integral side walls 14 and 16 extending downward from the side edges of wall 12, and end walls 18 and 20 extending downward from the end edges of wall 12. In addition, bottom wall sections 22 and 24 extend inwardly from the lower edges of end walls 18 and 20, respectively, parallel to upper wall 12. The walls together form a container storage cavity beneath upper wall 12. End walls 18 and 20 include access openings 26 and 28, respectively, for insertion of a wipes container into the platform cavity.

Stool 10 is further comprised of removable shelf 30 that is slidable through opening 26 or 28. Shelf 30 includes ports 32 for removal of wipes from a container (not shown) positioned within the platform cavity without removing the container from the platform cavity.

Figure 3:
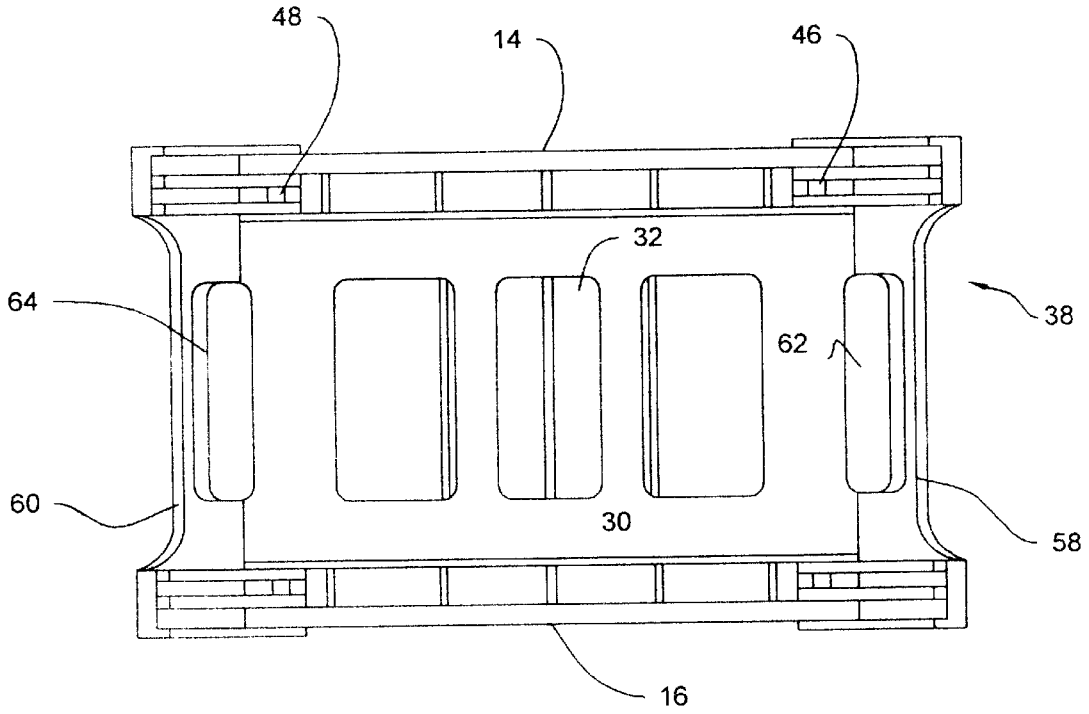
FIG. 3 is a bottom view of the stool with the legs in the extended position.
Figure 4:
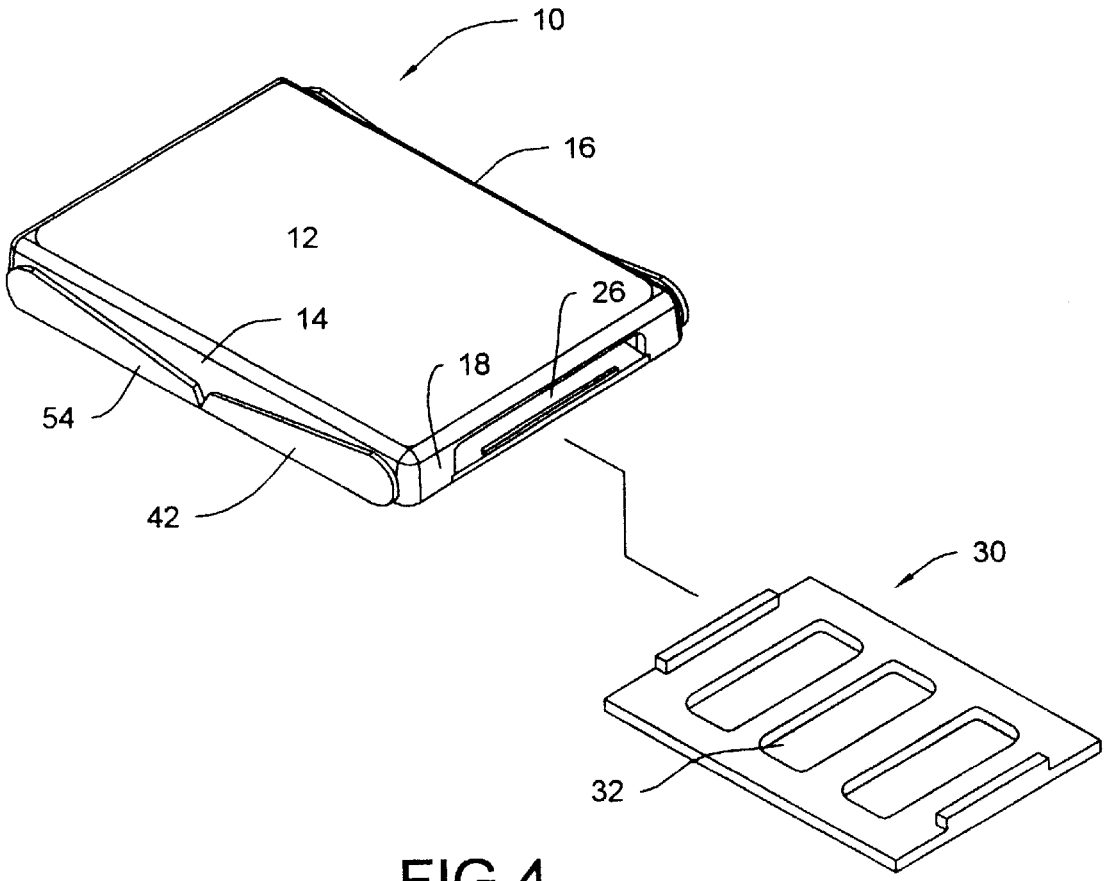
FIG. 4 is a perspective view of the step stool with the legs in the closed position and the shelf removed from the platform cavity.

Stool leg, generally 38, is comprised of a center section 40 extending substantially the width of the platform, and side sections 42 and 44 that extend inwardly from the side edges of center section 40. The upper ends of side sections 42 and 44 are pivotally joined to the outer ends of side walls 14 and 16 by pivot pin 46. Stool leg, generally 50, is similarly constructed of center section 52 and side sections 54 and 56, with joinder by pin 48, and functions in the same manner as leg 38. As illustrated in FIG. 3, legs 38 and 50 are about one-half the length of sidewalls 14 and 16 and meet at their distal ends when folded in the closed position. Center sections 40 and 52 are parallel to upper wall 12.

When in the opened, extended position, the upper edges of center sections 40 and 52 engage the lower surfaces of bottom wall sections 22 and 24, respectively, to limit outward movement of legs 38 and 50. Lower edges 58 and 60 of center sections 40 and 52, respectively, include cut-out sections that join to form an opening into the container cavity when legs 38 and 50 are in the closed position. Foam rubber grip pads 62 and 64 are positioned on the inner surfaces of center sections 40 and 52, respectively, to facilitate opening and closing.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A collapsible step stool with a storage cavity for storing a wipes container comprising:

a) a platform having an upper wall with side and end edges, side walls extending downward from said upper wall side edges and end walls extending downward from said upper wall end edges, said upper, side and end walls forming a storage cavity beneath said upper wall;

b) a removable support shelf positioned beneath said storage cavity said shelf including a first storage cavity access opening; and c) legs pivotally attached to said platform, said legs being moveable between a closed position beneath said shelf and an opened position, said legs having cut-out sections forming a second storage cavity access opening over lapping aligned with said first access opening when said legs are in the closed position.

2. The stool of claim 1, wherein said platform includes bottom wall sections supporting said shelf, said legs abutting said bottom wall sections when said legs are in the opened position.

3. The stool of claim 1, wherein said legs have inner surfaces, said stool further including gripping pads on said leg inner surfaces.

4. The stool of claim 1, wherein each of said legs has a center section with a lower edge including a cut-out section, and side sections, said center sections being parallel to said platform upper wall and said side sections being adjacent the exterior of said platform side walls, when said legs are in the closed position.

5. The stool of claim 1, wherein at least one of said end walls including an opening into said storage cavity, said shelf being insertable through said end wall opening.

6. A collapsible step stool with a storage cavity for storing a wipes container comprising:

a) a platform having an upper wall with side and end edges, side walls extending downward from said upper wall side edges and end walls extending downward from said upper wall end edges, said upper, side and end walls forming a storage cavity beneath said upper wall;

b) a removable support shelf positioned beneath said storage cavity said shelf including a first storage cavity access opening, at least one of said end walls including an opening into said storage cavity, said shelf being insertable through said end wall opening; and c) legs pivotally attached to said platform, said legs being moveable between a closed position beneath said shelf and an opened position, each of said legs being approximately one-half the length of said platform and having a center section with a lower edge including a cut-out section, said legs cut-out sections together forming a second storage cavity access opening over lapping aligned with said first access opening when said legs are in the closed position.

7. The stool of claim 6, wherein said platform includes bottom wall sections supporting said shelf, said legs abutting said bottom wall sections when said legs are in the opened position.

8. The stool of claim 6, wherein said legs have inner surfaces, said stool further including gripping pads on said leg inner surfaces.

9. The stool of claim 6, wherein each of said legs has side sections, said side sections being adjacent the exterior of said platform side walls when said legs are in the closed position.

* * * * *